United States Patent [19]

Grisé et al.

[11] Patent Number: 4,766,781

[45] Date of Patent: Aug. 30, 1988

[54] JAR OPENER

[76] Inventors: Frederick G. J. Grisé, P.O. Box 186, Osterville, Mass. 02655; Carlton D. Adams, 3 Commonwealth Ave., Attleboro, Mass. 02703

[21] Appl. No.: 9,878

[22] Filed: Feb. 2, 1987

[51] Int. Cl.[4] ..... B67B 7/18

[52] U.S. Cl. ..... 81/3.4

[58] Field of Search ..... 81/3.4, 3.43, 3.07

[56] References Cited

U.S. PATENT DOCUMENTS 1,960,531 5/1934 Driscoll ..... 81/3.4

2,761,337 9/1956 Daniel ..... 81/3.4

3,604,290 9/1971 Waite ..... 81/3.4

4,622,250 5/1987 Kee ..... 81/3.4

FOREIGN PATENT DOCUMENTS 1328723 8/1973 United Kingdom ..... 81/3.42

*Primary Examiner*—Roscoe V. Parker

*Attorney, Agent, or Firm*—Charles R. Fay

[57] ABSTRACT

A jar or bottle lid or cap remover or opener comprising only two conical members, i.e. a relatively hard outer pressure cone and an inner elastomeric insert, and a space between the two.

17 Claims, 1 Drawing Sheet

FIG. 1
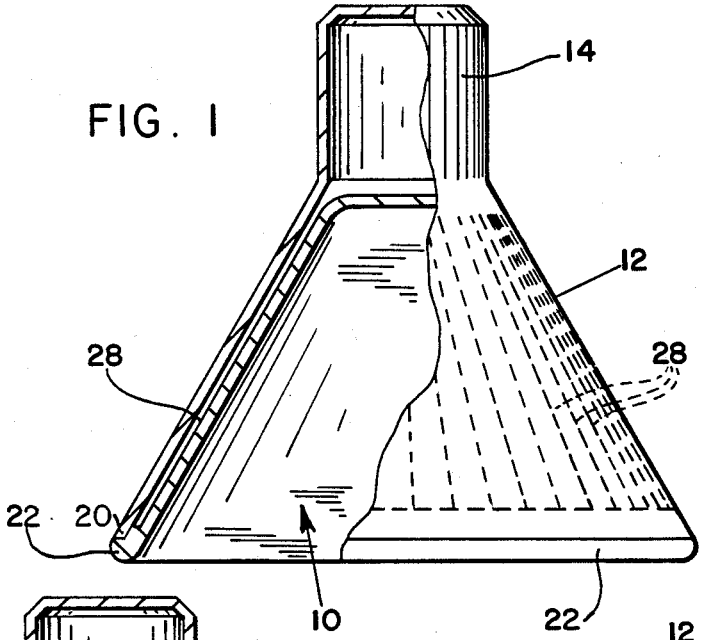
FIG. 2
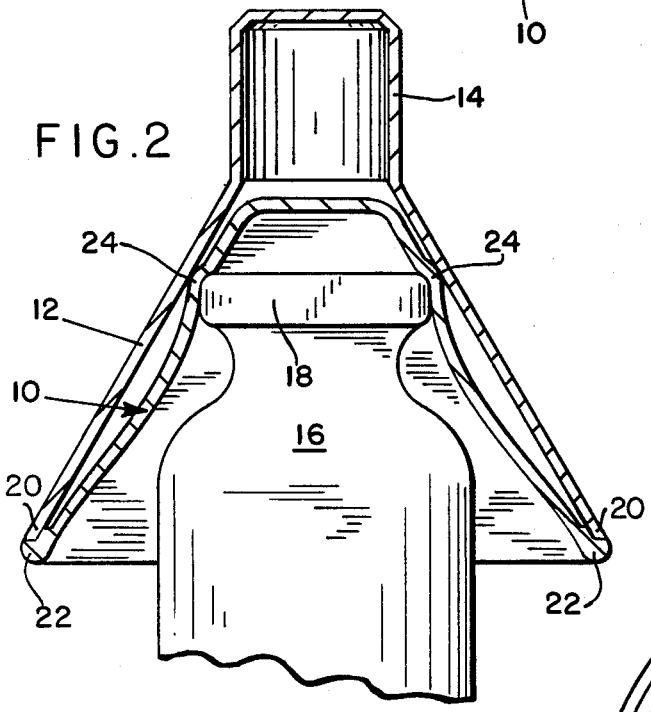
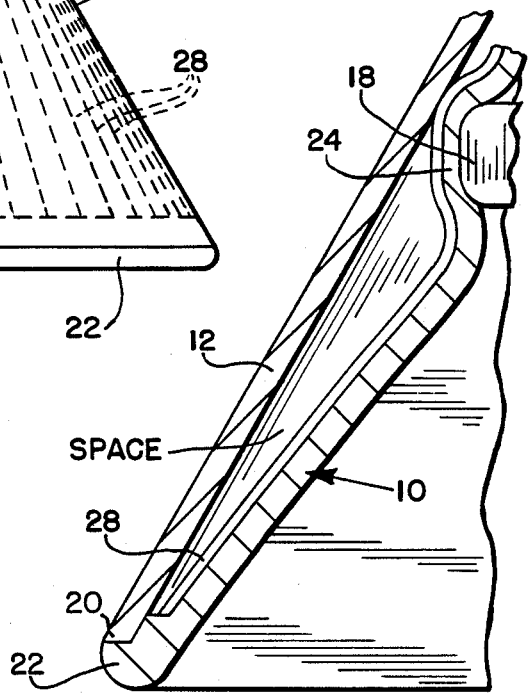
FIG. 4
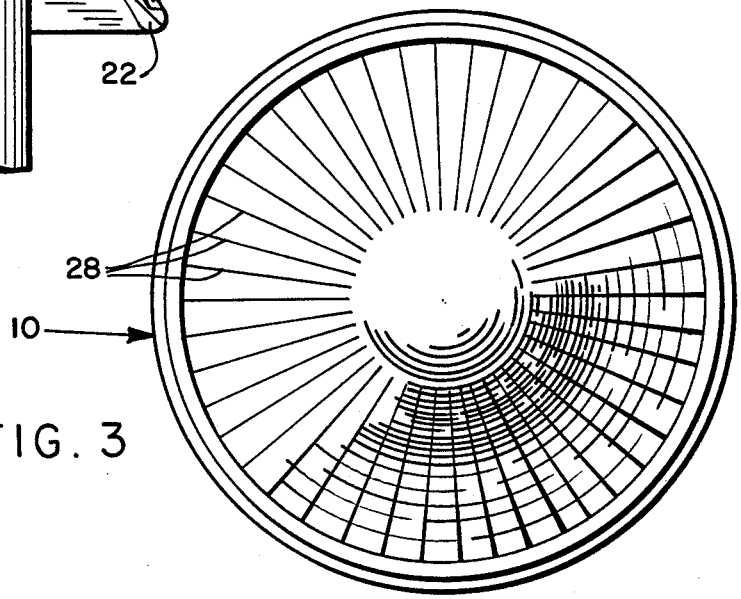
FIG. 3

JAR OPENER

FIELD OF THE INVENTION

Domestic jar opener having a resilient gripping device for the bottle cap or jar lid.

BACKGROUND OF THE INVENTION

There are many assists for the kitchen adapted to aid in the removal of jar lids and caps, and these devices are often necessary because the lids are firmly applied at the factory to insure against accidental opening and spilling. These assists range from rubber or abrasive cloths to be simply manually applied to the cap, to more elaborate devices such as stepped, toothed devices and hollow members with lid gripping interiors. The present device is hollow and conical with special new and improved structure providing greater grip on the cap and less slip at its circumference for better force or pressure on the cone. Many containers have very stubborn caps that are very difficult to remove, even with assists, and any improvement in the grip to be afforded by the hands of the user or consumer is a step in the right direction.

SUMMARY OF THE DISCLOSURE

The present jar opener comprises essentially two open hollow conical members, an outer hard and stiff pressure member having a closed smooth smaller end forming a hard grip, and an insert of elastomeric material generally conforming to the outer pressure member and having an open wider end that overlaps the edge of the pressure member at the wide open end thereof, forming padding for this edge. Means is provided to generally space the pressure member from the insert a small amount generally evenly throughout the conical structure. This space, or spaces, is very important because when a jar with a tight lid is introduced and pressed down upon, the elastomeric material of the insert is stretched and distorted by the lid and thereby creates an improved grip by enveloping the rim of the lid to a greater extent than would be the case were the insert flat up against the interior surface of the stiff outer pressure member. While a soft insert yields and forms some grip, in the latter case, it will not grasp by enveloping the rim of the lid anywhere near the extent afforded by the present cap or lid remover construction having space between the two parts. This space provides for a greater yielding and stretching effect of the elastomeric material. Often improvements will appear hereinafter.

BRIEF DESCRIPTION OF THE DRAWINGS

FIG. 1 is an elevational view with parts broken away and in sections, showing the new jar lid remover;

FIG. 2 is a sectional view of the jar lid remover, illustrating the stretching action of the elastomeric insert in use to open a bottle or jar;

FIG. 3 is a top plan view of the elastomeric insert per se, the outer pressure member being removed, and FIG. 4 is a section on an enlarged scale, similar to the left hand portion of FIG. 2.

PREFERRED EMBODIMENT OF THE INVENTION

The jar opener, i.e. lid or cap remover, the present invention comprises but two parts, both made by molding. There is a relatively hard, stiff outer member or pressure cone, and an inner elastomeric insert, also of general cone shape. The elastomeric insert, generally indicated at 10, fits into the larger pressure cone 12, but at the apex, these parts need not fit, and the insert is made shorter than a hand-hold 14 that terminates the small end of the pressure cone. The member 14 is made to provide as much comfort and ease of handling as possible when the jar opener as a whole is manually pressed down on a bottle 16 having a jar cap or lid. This bottle or jar has a closure 18 which is to be removed.

At the open end of the device, the skirt of the insert is turned over the edge of the pressure cone and can be interlocked with a lip 20 on the pressure cone, as shown at 22, FIGS. 1 and 2. The parts may be fitted as by stretch of the elastomeric material of the insert, or adhesively joined, or connected in any way found convenient, but in any case, the pressure cone is provided with a suitable relatively soft covering at the open end edge thereof.

The grip of the jar opener on the cap or lid 18 is greatly enhanced by reason of the fact that the pressure cone is spaced from the insert, or inner member, so that pressure on the cone apex causes the material of the elastomeric insert to stretch and distort, thereby providing a greater area of insert to firmly contact or grasp the edge of the cap or lid. This is shown in FIG. 2 at 24. By this means the device exerts a greater holding power on the cap or lid and thereby the same is more easily and quickly removed with much less slippage of the jar opener relative to the cap or lid.

Means is provided to form and maintain the space between the inner surface of the outer member of pressure cone and the outer surface of the inner elastomeric insert. These two parts are made in sizes to provide the spacing but actual mechanical means is preferred to form a unit that will last indefinitely and in this case this means it is in the form of finger-like protuberances 28 between the inner surface of the outer cone and the outer surface of the insert. These fingers are mutually circumferentially spaced and extend in the manner of rays from adjacent the hand-hold 14 to a line parallel to but spaced from the rim of the pressure cone as at 28. The elastomeric material of the insert will stretch and distort against these fingers to a degree, but this action also takes place and to a greater degree between fingers, because of the aforesaid space.

It will be seen that the greatest grip on the lid or cap to be removed is provided under manual operation, and that therefore the optimum opening ability is imparted to the device. Also, by texturizing the inner surface of the insert, some additional grip may be provided.

I claim:

1. A jar opener comprising a hollow generally cone shaped member having a small enclosed end and an open wide end to receive a jar cap or the like therein, said member comprising a relatively stiff outer cone and a flexible distortable insert therein generally co-extensive with the outer cone, and means normally spacing the insert from the outer cone, whereby pressure may be exerted by the outer cone, throught the insert, to the jar cap or lid, thereby distorting the insert and conforming the same at least in part to the cap or lid, and thereby exerting pressure on the cap or lid at its periphery and increased gripping effect of the flexible insert on the cap or lid.

2. The jar opener of claim 1 wherein the inner or gripping surface of the insert is textured for greater grip.

3. The jar opener in claim 1 wherein the means spacing the outer cone and the insert includes circumferentially spaced elements.

4. The jar opener of claim 3 wherein said elements are elongated and extend for a major portion of the cone from the small closed end of the cone toward the wide open end thereof.

5. There jar opener of claim 4 wherein the spacing of said elongated spacing elements increase in width from the small end of the cone toward the open wide end thereof.

6. The jar opener of claim 1 wherein the flexible insert extends around and over the terminal edge of the wide open end of the cone.

7. A jar opener comprising a hollow conical member having a relatively stiff outside and a relatively soft, stretchable inside, a conical space between the hard and soft sides so that an object engaging the soft soft side distorts and pushes the soft side back against the hard side and stretches to conform to the object, thereby providing a firm grip on the object under conditions of pressure between the member and object, the small end of the member providing means whereby the member may be manually grasped to exert pressure on the object.

8. The jar opener of claim 7 including means forming the space between the sides, said means comprising circumferentially mutually spaced fingers extending a major portion of the length of the member.

9. The jar opener of claim 7 wherein the outside of the member is a stiff shell and the inside is a seperate soft, distortable insert.

10. The jar opener of claim 9 wherein the outside stiff shell extends over the smaller end of the member, forming a palm-engaging means for manual application of force onto the object engaged with the soft side.

11. A jar opener comprising a relatively stiff, hollow open end conical member and an elastomeric hollow open end conical insert therein, means connecting the member and insert together at the respective edges of the open ends thereof, a series of circumferentially mutually spaced elements between the member and the insert forming circumferentially mutually spaced spaces between the member and the insert, said elements extending from adjacent the small end to a point adjacent the large end of the conical structure, said spaces providing for distortion and stretch of the elastomeric material of the insert upon application of the jar opener with pressure to an object, thereby applying a firm gripping action of the jar opener to said object.

12. The jar opener of claim 11 wherein the spaces gradually widen from the small end part of the jar opener toward the wider end of the conical structure, thereby providing greater grip on a large object.

13. The jar opener of claim 11 wherein the elements are free-ended at the ends thereof adjacent the large end of the conical structure.

14. The jar opener of claim 11 wherein the spacing elements are integral with the conical member.

15. The jar opener of claim 11 wherein the elements are fixed with relation to the stiff conical member.

16. The jar opener of claim 11 wherein the elements are integral with the stiff conical member.

17. The jar opener of claim 11 wherein the elements are unattached relative to the elastomeric insert.

* * * * *